US005217122A

United States Patent [19]

Martinez

[11] Patent Number: 5,217,122

[45] Date of Patent: Jun. 8, 1993

[54] ADJUSTABLE BOOKEND APPARATUS

[76] Inventor: Beatrice E. Martinez, 1401 Middlebury Dr., Alexandria, Va. 22307

[21] Appl. No.: 956,151

[22] Filed: Oct. 5, 1992

[51] Int. Cl.[5] ..... A47F 7/00

[52] U.S. Cl. ..... 211/43; 211/184

[58] Field of Search ..... 211/43, 184, 162, 89; 108/60, 61

[56] References Cited

U.S. PATENT DOCUMENTS

| | | | |
|---|---|---|---|
| 560,851 | 5/1896 | Hine | 211/43 |
| 1,674,582 | 6/1928 | Wheeler . | |
| 2,134,606 | 10/1938 | Hackworth et al. | 211/43 X |
| 2,545,844 | 3/1951 | Cougias . | |
| 2,911,103 | 11/1959 | Kunkler . | |
| 3,146,888 | 9/1964 | Schaefer et al. | 211/43 |
| 3,202,298 | 8/1965 | Koreska | 211/43 X |
| 3,389,805 | 6/1968 | Yeomans . | |
| 4,742,936 | 5/1988 | Rein . | |

FOREIGN PATENT DOCUMENTS 359275 3/1906 France .

*Primary Examiner*—Alvin C. Chin-Shue
*Assistant Examiner*—Sarah A. Lechok
*Attorney, Agent, or Firm*—Oliff & Berridge

[57] ABSTRACT

A lightweight adjustable retaining apparatus is located on an underside of a shelf and is capable of retaining books between a downwardly extending movable bookend and a fixed stationary vertical support. The retaining apparatus includes a stationary base having side walls and a hollow portion defined therebetween. Compressed spring members are located in guide channels substantially adjacent lengthwise edges of the side walls. The movable bookend is guidably supported by the guide channels and urged by the spring members to retain a variable number of books between the movable bookend and the fixed vertical support.

22 Claims, 6 Drawing Sheets

ADJUSTABLE BOOKEND APPARATUS

BACKGROUND OF THE INVENTION

The present invention relates to an adjustable apparatus for retaining a variable number of books on a shelf unit. In particular, the apparatus includes a stationary base which is affixed to an underside of a horizontal shelf and retains books between a vertical support and at least one longitudinally movable vertical bookend through the use of two compressed springs which are located substantially adjacent side edges of the apparatus.

U.S. Pat. No. 2,545,844 to Cougias discloses an adjustable bookrack having book supporting ends slidably interconnected by mating tongue and groove extensions. Two tension springs are located between the supporting ends in tubes which are within central bores. The book-rack serves to maintain books between the supporting ends. The bookrack is in an upright position which rests on top of a shelf.

U.S. Pat. No. 3,389,805 to Yeomans discloses an adjustable telescoping bookend apparatus having upright bookends which are urged together by a centrally located resilient spring. A movable section is supported by wheels which are movable along a stationary section.

French Patent No. 359,275 to Petit discloses an adjustable support which includes two upright fixed supports and a movable support located between the fixed supports. The movable support is resiliently urged toward one of the fixed supports by a centrally located spring. The movable support is guided along tongue and groove elements.

U.S Pat. No. 1,674,582 to Wheeler discloses a bookholder which includes a fixed upright support and a movable support resiliently attached by a centrally located spring. The movable support is guided in a tongue and groove assembly.

U.S. Pat. No. 2,911,103 to Kunkler discloses a device for supporting books which includes two movable upright supports urged together by a centrally located spring.

Although adjustable bookends are known in the art, there are problems with existing structures. It is often desirable to retain a variable number of books on a shelf. While prior bookends may suffice for some applications, there are times when these are not acceptable. Often times in an existing shelf for which books are desired to be retained, there is a need for the overall appearance of the shelf and a bookend to match or blend in with each other. One may be able to locate an adjustable bookend in a color which matches the existing shelving color. However, it would be desirable to have as much of the adjustable bookend out of sight as possible. With existing bookends which are located on top of shelving, a majority of the bookend will always be visible.

Another problem with existing bookends is the size and strength required to support books of sometimes large overall weight on the bookend apparatus. This usually involves a higher cost of production and larger quantities of material for each bookend. Additionally, since the books are placed on a base of the bookend, an adjustable bookend of this type requires a wide flat support surface to support the books.

Yet another problem with adjustable bookend apparatus is a clearance problem associated with some shelving. Often times shelving is sized to accommodate a certain size of book. Although some shelving may allow greater tolerances, others have small tolerances in dimensions such as overall height between shelving. For example, some shelving assemblies include a front face member which extends downward below a shelf a distance to provide the appearance of wide shelving and to improve visual appearance of the shelving. Such an arrangement creates a recessed portion between a lowermost part of the front face member and the bottom of the shelf on which the front face member is attached. This recessed portion defines a space which is not utilized by the shelving since the height of books which can be accommodated is determined by the height between a horizontal support on which the books rest, which may be a lower shelf, and the front face member.

Additionally, in some non-enclosed shelving, there exists a lowermost shelf which is supported a distance above the floor such that books can be placed under the shelf on the floor. In such arrangements, there was either no adjustable support provided or an external bookend apparatus was placed on the floor to retain the books.

There is a need for an adjustable retaining apparatus which can overcome the deficiencies of the prior art and which can utilize existing space for locating an adjustable retaining apparatus without sacrificing height accommodation of books on the shelf.

SUMMARY OF THE INVENTION

It is an object of the present invention to overcome the above problems and provide an adjustable retaining apparatus and method which is capable of installation on an underside of a shelf allowing the apparatus to be substantially hidden from view and allowing for reduced weight and structural rigidity of the apparatus Thus, the apparatus can be manufactured at a lesser cost from substantially lighter products using less material.

It is a further object of the present invention to provide an adjustable retaining apparatus which can be attached in a recessed area behind a front face member of a shelf unit, the utilization of such space maintaining the overall height of books which can be inserted and retained on the shelf.

It is another object of the present invention to provide an adjustable retaining apparatus which can easily be attached to existing shelving to allow adjustable retention of a variable number of books.

It is yet another object of the present invention to provide a simple, reliable adjustable retaining apparatus which retains a movable vertical bookend in position without pivotal movement of the movable bookend.

The present invention achieves the above and other objects and overcomes the above and other deficiencies of the prior art by providing a lightweight adjustable retaining apparatus located on an underside of a shelf. The retaining apparatus is capable of retaining books between a downwardly extending movable bookend and a fixed stationary vertical support, which may be a vertical wall of the shelf or a fixed vertical support located on the retaining apparatus. The apparatus includes: a stationary base affixable to a lower side of a horizontal shelf, the base having two horizontally extending side walls defining lengthwise edges of the base and a longitudinally extending central hollow portion between the side walls; two helical spring members, one spring member being located substantially adjacent each lengthwise edge; a guide within the base for containing and guiding the spring members, allowing the spring members to longitudinally extend and compress while minimizing lateral spring deflection; and at least one downwardly extending vertical bookend extending between the side walls and longitudinally movable in the hollow portion along the sidewalls by the spring members, the movable vertical bookend being capable of retaining at least one book between the bookend and a second vertical support.

BRIEF DESCRIPTION OF THE DRAWINGS

The invention will be described in detail with reference to the following drawings wherein.

DETAILED DESCRIPTION OF PREFERRED EMBODIMENTS

Figure 1:
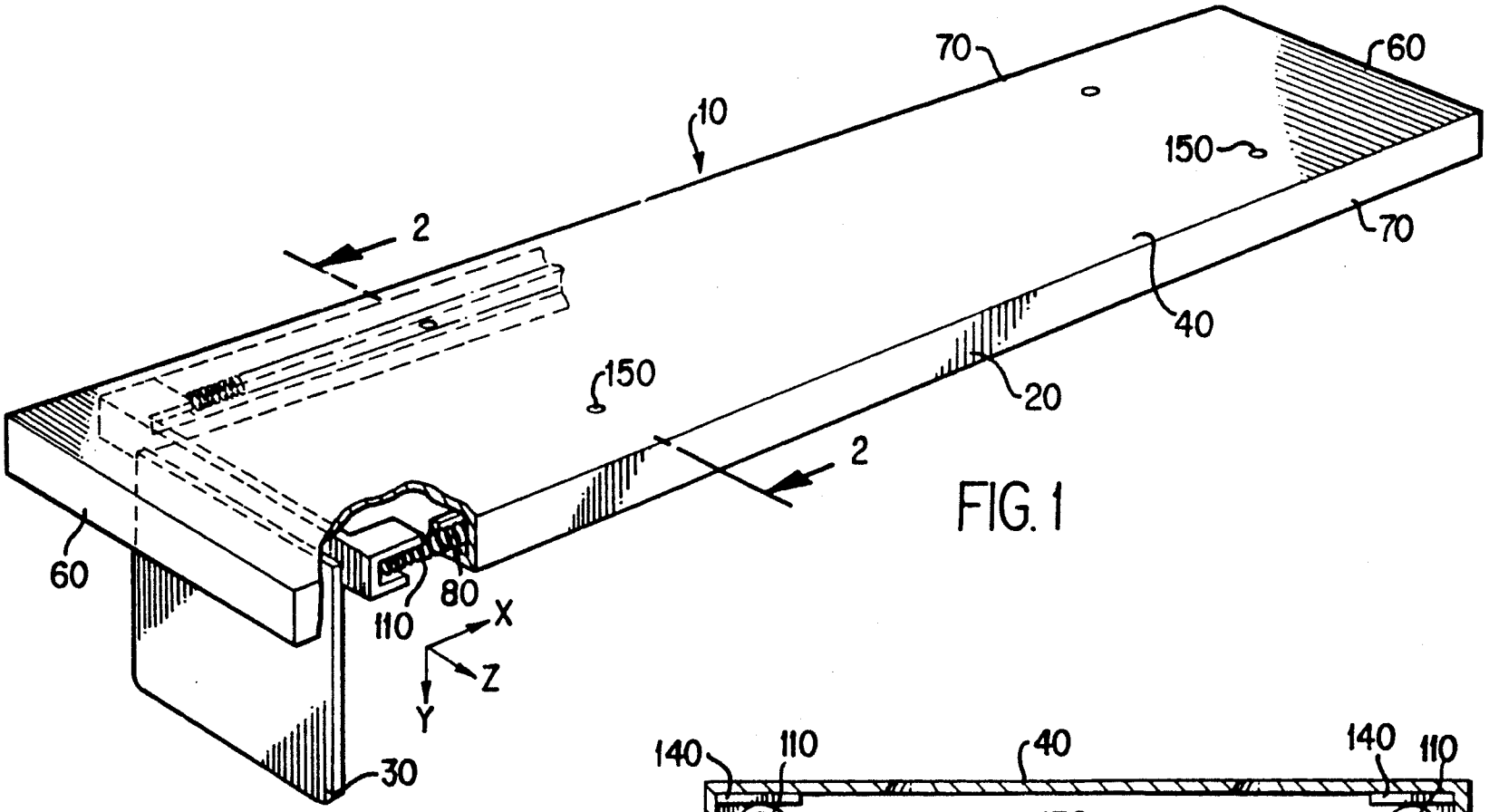
FIG. 1 shows an isometric view of an adjustable book retaining apparatus according to the present invention.
Figure 2:
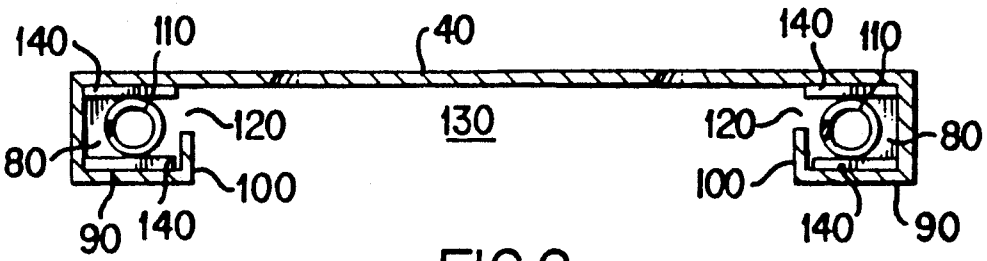
FIG. 2 shows a cross-sectional view of the adjustable retaining apparatus of FIG. 1 taken along line 2—2.
Figure 3:
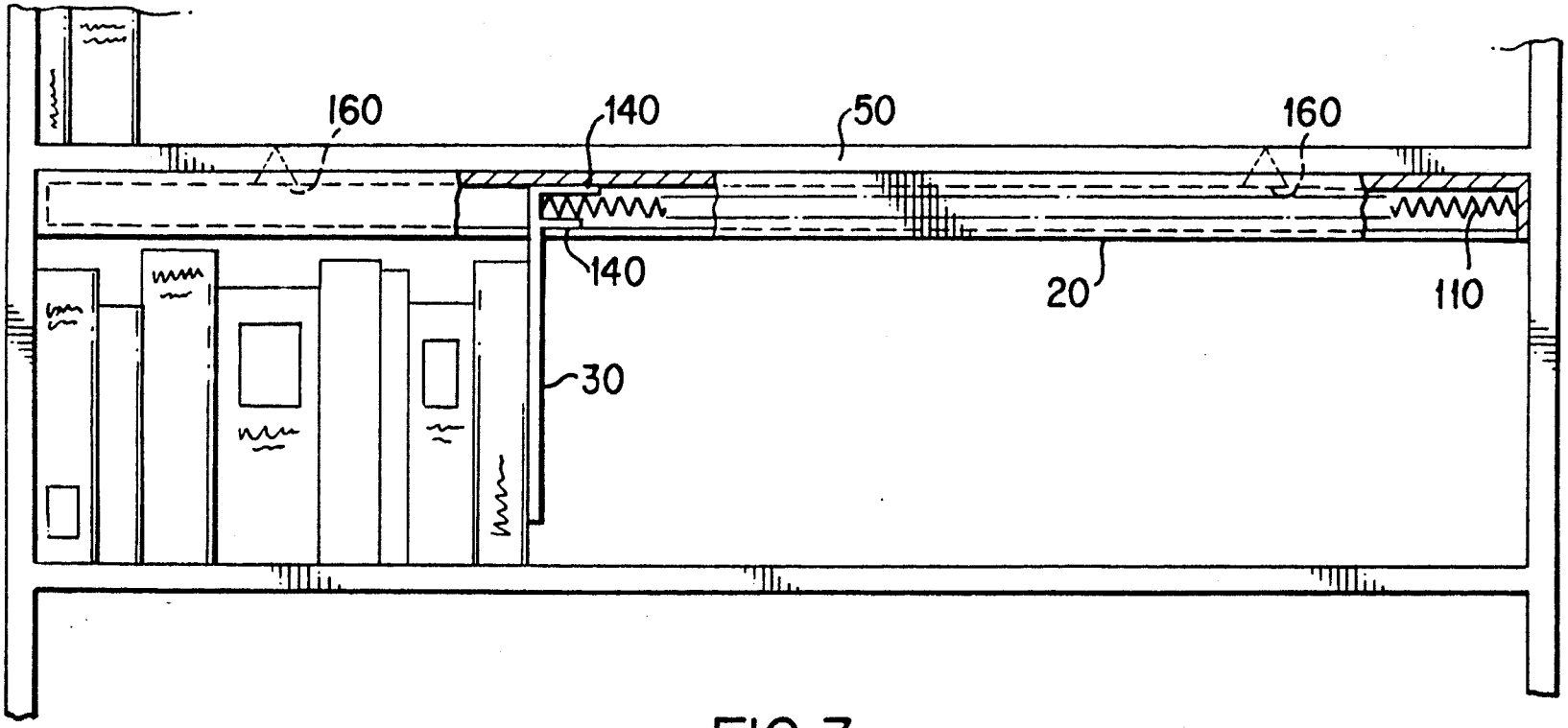
FIG. 3 shows a side view of the apparatus attached to a shelf unit.

The present invention as shown with reference to FIGS. 1-3 is directed to an adjustable retaining apparatus 10 which includes a stationary base 20 on which a downwardly extending vertical bookend 30 is movably mounted. The stationary base 20 as shown in FIG. 1 includes a flat top surface 40 sized to be accommodated within a horizontal shelf 50 (FIG. 3). The base 20 includes two side ends 60 and two longitudinally extending side walls 70, the longitudinally extending side walls 70 defining lengthwise edges. The longitudinally extending side walls 70 are part of longitudinally extending guide channels 80.

As shown in FIG. 2, the guide channels 80 can include a short longitudinally extending wall member 90 attached to a lower side of the side walls 70 and substantially parallel with flat top surface 40. The guide channels 80 also include a vertical lip member 100 extending partially from the wall member 90 toward the top surface 40. The vertical lip member 100 extends upward a distance sufficient to retain a spring 110 in each channel 80. An open space 120 between the vertical lip 100 and the top surface 40 allows longitudinal movement of the downwardly extending vertical bookend 30 which is movably guided within the guide channels 80.

Figure 4:
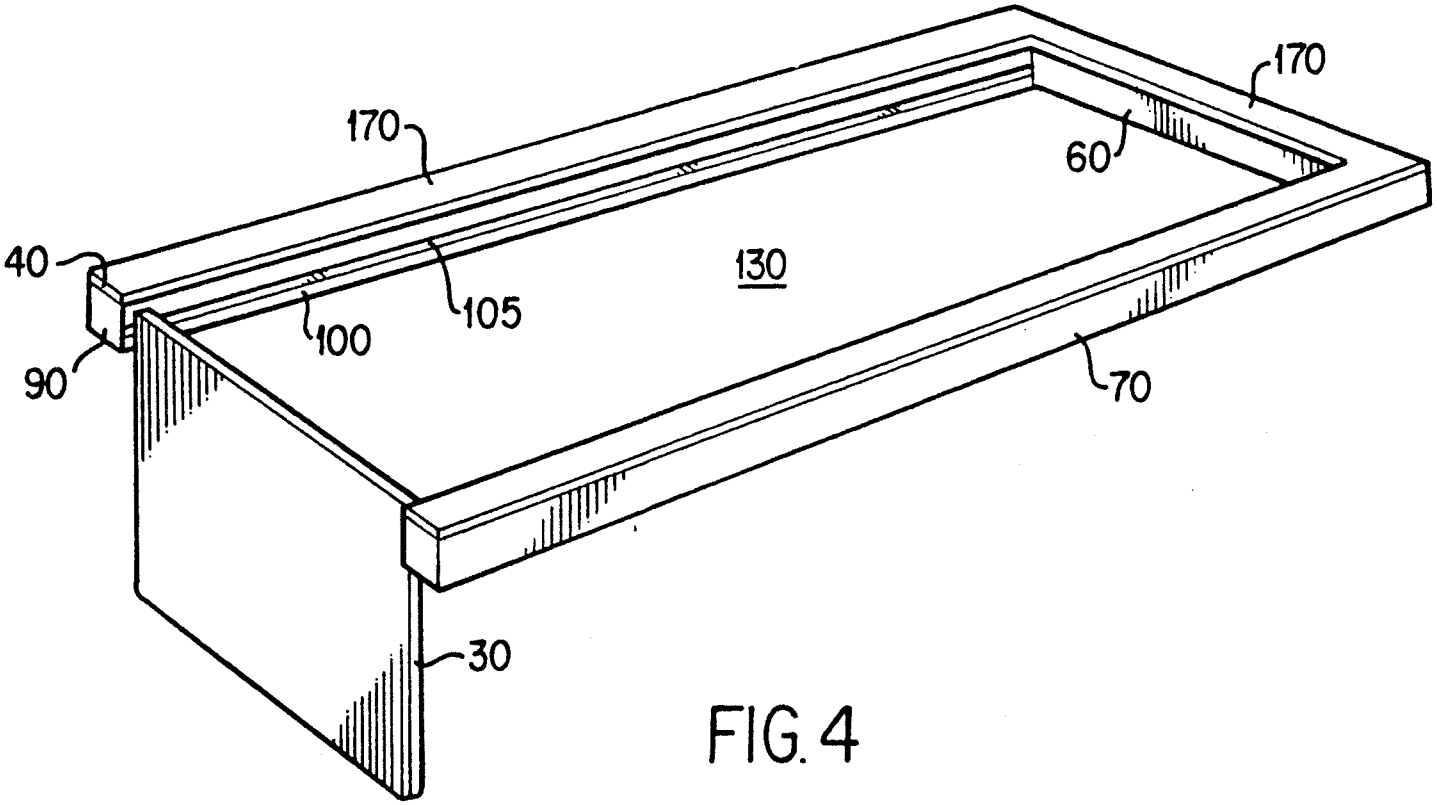
FIG. 4 shows an isometric view of another embodiment of an adjustable retaining apparatus according to the present invention.

As shown in FIG. 4, the guide channels may alternatively include a vertical lip member 100 which extends completely from wall member 90 to top surface 40. Longitudinal movement of vertical movable bookend 30 is allowed by providing a lengthwise slot 105 in the lip member 100. Other suitable means of retention of the spring 110 within the guide channels 80 and movement of the vertical bookend 30 within the channels 80 may be utilized.

The base 20 further includes a longitudinally extending hollow portion 130 which extends between the side walls 70, and in particular between the guide channels 80. The hollow portion 130 is provided to allow unrestricted longitudinal movement of the vertical bookend 30 in this portion.

The springs 110 are compressed springs which extend across the side walls 70 within the guide channels 80. The springs 110 are located substantially adjacent the lengthwise edges of side walls 70 to provide stable movement of the movable vertical bookend 30. By being at the lengthwise extremities of the vertical bookend 30, the bookend 30 more easily resists pivotal movement which could hinder longitudinal movement of the vertical bookend 30 in guide channels 80. Preferably, the vertical bookend includes horizontally extending support surfaces 140 which additionally aid in preventing pivotal movement of the vertical bookend 30 about the Y and Z axes as shown in FIGS. 1 and 2. Although lower and upper horizontal support surfaces 140 are shown, it would be suitable to utilize either the upper or lower support surface or substitute equivalent structures such as rollers. The support surfaces 140 and the guide channels 80 can be of the same or dissimilar materials and either or both may include a coating of a low coefficient of friction material to enhance movement of the vertical movable bookend 30 within the guide channels 80.

The springs 110 may be attached at one end to a side end 60 and at the other end to a portion of vertical bookend 30 located within the guide channel 80 by known attachment means such as gluing, welding, molding, etc., although it may be suitable to have the springs 110 loosely located within the guide channels 80 without affixing. In this case, the springs 110 are held within the guide channel 80 by frictional fit against a side end 60 and a portion of the vertical bookend 30 within the guide channel 80.

The adjustable retaining apparatus 10 can be attached to a lower side of a horizontal shelf 50 by any of a number of methods. As shown with respect to FIG. 1, the flat top surface 40 may be provided with a plurality of screw holes 150 through which screws 160 (FIG. 3) may be inserted to attach the apparatus to the underside of the shelf 50. This particular approach is simple and works well to attach the apparatus to a wood shelf or a hollow metal shelf through which the screws 160 can be fixedly inserted. Although four screw holes are shown, one may utilize more or less screws and modify their locations depending on the dimensions and weight of the apparatus 10. Other methods of attachment are possible such as double sided adhesive 170 (FIG. 4) which can be attached to the flat top surface 40 and then adhered to the underside of the shelf 50. This particular method works well on smooth nonporous surfaces such as metal, plastic or laminated wood. Many currently available double sided adhesives are known in the art and readily available at most any hardware or building supply store. Other suitable methods of affixing the retaining apparatus to a shelf may also be used.

The retaining apparatus 10 may be formed of any suitable material, although it is most suitable and economical to form the apparatus from molded plastic or wood, although it could also be formed of aluminum or other metals. The apparatus can be formed by known methods, such as for example, by injection molding of plastic.

Another embodiment of the present invention is shown in FIG. 4. In this embodiment, the flat top surface is U-shaped. This results in a minimal amount of material which is needed for construction of the retaining apparatus, thus reducing the ultimate cost of the apparatus and further reducing the weight of the apparatus. This structure would not be desirable in conventional bookends which are located on top of the shelf. The books to be retained need a flat surface on which to rest. If the books are small in the Z direction (as shown in FIG. 1), the book may fall between the side walls when accommodated on the shelf. Additionally, if the books are large in the Z direction, they may not be supported sufficiently close to their widthwise extremities, resulting in the book possibly falling off of the base of the bookend or at least causing undesirable pivoting of the book. Also, due to the large number of books which can be placed on the bookend base, and the cumulative weight thereof, the base may not be capable of supporting the weight without added reinforcement or added structural materials which add to the complexity of the apparatus, the amount of raw materials and the ultimate manufacturing cost.

However, since the present invention is attached on a lower side of a shelf above the books, there is no appreciable weight on the apparatus. The only force acting on the apparatus acts on the movable vertical bookend 30 due to the spring force of the springs 110 urging the bookend 30 against the books being accommodated and retained thereby.

Figure 5:
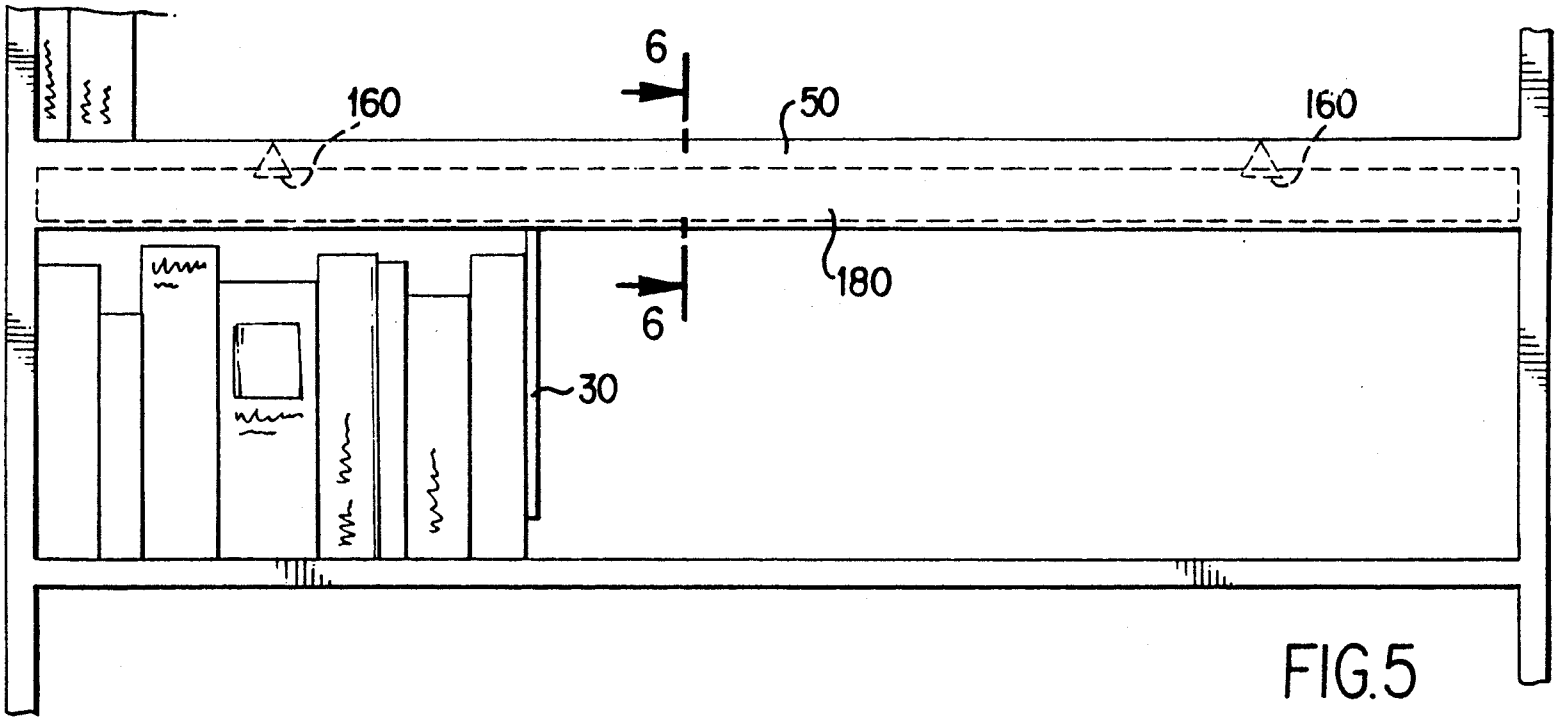
FIG. 5 shows a side view of an embodiment of an adjustable retaining apparatus according to the present invention installed under a shelf having a downwardly extending front face member.
Figure 6:
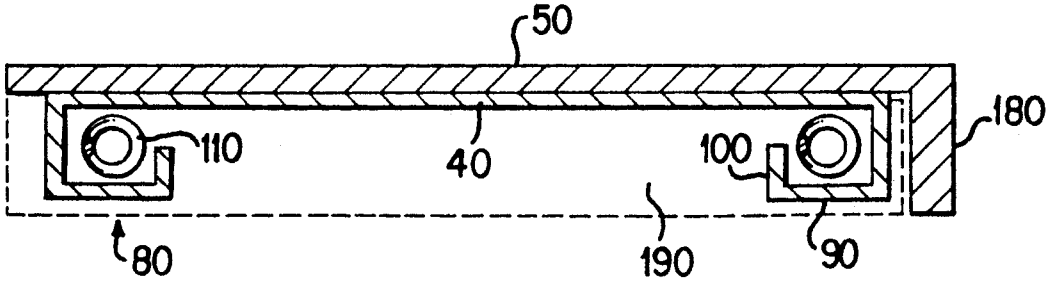
FIG. 6 shows a cross-sectional view of FIG. 5 taken along line 6—6.

As shown in FIGS. 5 and 6, the horizontal shelf 50 may be of the type having a front face member 180 which extends across the front of the shelf, downward a distance below the thickness of the shelf. This provides a wider front shelf appearance and results in a recessed area 190 (shown as dotted area in FIG. 6) which is normally unusable. These shelves are often designed such that a predetermined height exists between a lower shelf and the front face member, this height being the maximum size of a book which can be accommodated on the shelf. As stated above, if a bookend apparatus of the prior art is utilized, that is, one designed to be located on top of a shelf, the resultant overall height is reduced by an amount equal to the height of the base of the bookend. This results in some sizes of books, originally intended to be accommodated on a shelf, being too high to be accommodated. This is overcome by the present invention as shown by locating a retaining apparatus on an underside of an upper shelf in this recessed area 190. As long as the height of the stationary base portion of the retaining apparatus is less than the front face area, the shelf can accommodate the same size books with or without the apparatus. Further, even if the base protrudes beyond the front face, the amount of height accommodation negated by the retaining apparatus is equal only to the difference between the base and front face heights. Thus, utilization of the present invention in conjunction with a shelf having a front face member has negligible (if any) effect on the overall height of books which can be accommodated by the shelf.

Alternatively, the retaining apparatus 10 may be an integral part of the shelf 50. In this arrangement, the top surface 40 of the apparatus 10 forms the shelf 50 and is connected to vertical supports or sides to form shelving or a bookcase. Since the retaining apparatus 10 is integral, there is no loss in height between shelves. Additionally, by locating the movable vertical bookend 30 on the underside, the resulting structure retains a smooth aesthetic appearance on the upper side of the shelf, hiding from view the movable parts on the lower side thereof.

In all embodiments, and in particular with respect to the above two instances, the retaining apparatus is partially or completely hidden from view such that the book shelf can retain its original appearance.

Figure 7:
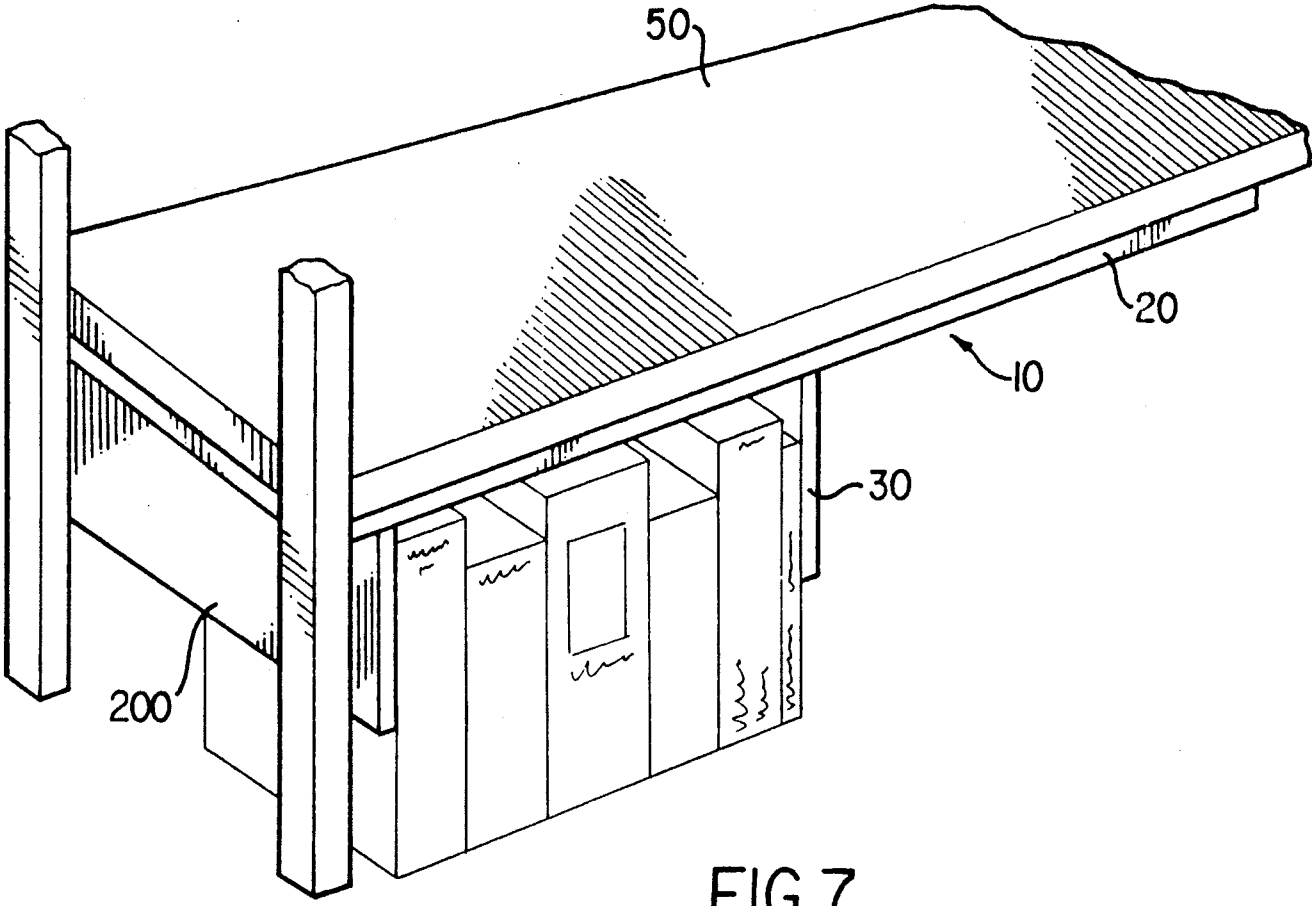
FIG. 7 shows a side view of yet another embodiment of an adjustable retaining apparatus having a fixed vertical support located at one end of the apparatus.

In FIG. 7, a retaining apparatus 10 is shown for use with a shelf having little or no vertical wall which could provide a stable vertical fixed support to retain the books. In this example, the apparatus 10 is provided with at least one vertical, preferably fixed, support 200. The vertical support 200 is shown located at the leftmost part of the apparatus 10; however, it may be located anywhere along the apparatus and may be provided at each end of the apparatus 10 in addition to the movable bookend 30 located therebetween. With such an arrangement, books may be adjustably retained between the at least one vertical support 200 and the movable bookend 30. This embodiment is especially well suited for use with shelving having frame type vertical members (as shown) and can retain books located on the floor below the shelving without utilizing external bookends on the floor.

Although only one vertical bookend is shown, it would be possible to include a plurality of movable bookends 30 and utilize a plurality of springs 110 in each guide channel 80.

Figure 8:
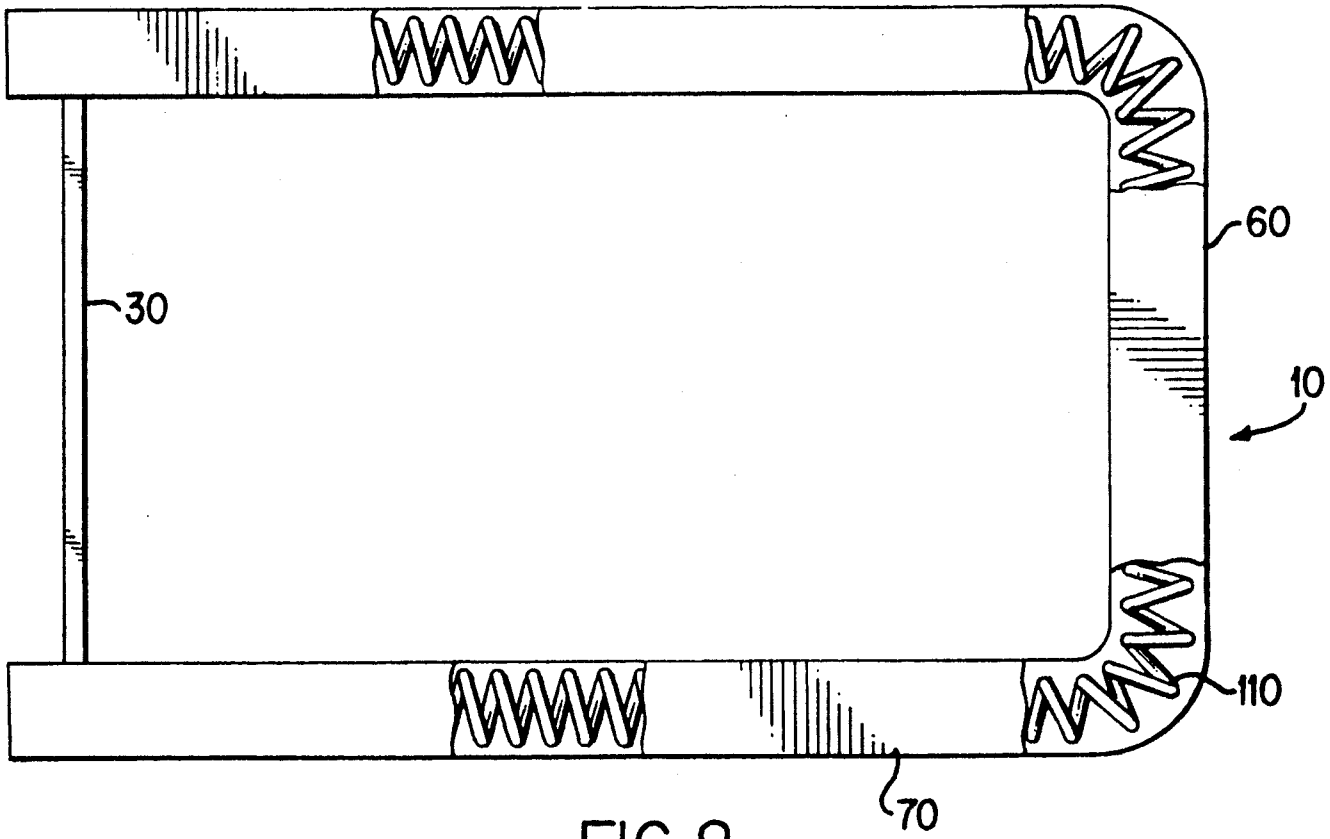
FIG. 8 shows a top view of the adjustable retaining apparatus according to another embodiment.

In place of the exemplary use of two compressed springs 110, the present invention, as typified in all of the above-mentioned embodiments, may be provided with a single spring 110 as shown in FIG. 8. This spring would, in an expanded state, extend the entire length of both sidewalls 70 and the length of one of the end walls 60. As such, the spring would take a U-shape and would bend around the intersections of the side walls 70 and the end wall 60. Preferably, the corners forming these intersections include smooth flowing tapered internal walls to allow the spring to freely compress and expand without constriction at the corners. An advantage of a single spring 110 is that the vertical bookend 30 is movable along substantially the entire lengthwise distance of the side walls 70, allowing the retaining apparatus 10 to accommodate a full shelf of books between the movable vertical bookend 30 and a vertical fixed support wall. By utilizing one spring 110, the apparatus 10 is able to provide the fully compressed state of the spring solely within the end wall 60, thus allowing the movable vertical bookend 30 to substantially traverse the lengthwise distance of the side walls 70. This traversal may also be accomplished using two springs 110 by locating an end of each spring 110 a distance within the end wall 60. The end may be retained in the end wall by any suitable fastening means. For example, internal partitions may provide a stop for the springs 110. Additionally, the springs 110 may be fastened by bonding, welding, molding, taping, or other suitable techniques.

The invention has been described with reference to preferred embodiments thereof, which are illustrative and not limiting. Various changes may be made without departing from the spirit and scope of the invention as defined in the appended claims.

What is claimed is:

1. Adjustable apparatus for retaining a variable number of books on a shelf unit having a horizontal shelf, the apparatus comprising:

a stationary base affixable to a lower side of a horizontal shelf, said base having two horizontally extending side walls defining lengthwise edges of said base and a longitudinally extending central hollow portion between said side walls;

two helical spring members, one said spring member located substantially adjacent each said lengthwise edge;

a guide within said base for containing and guiding said spring members, allowing said spring members to longitudinally extend and compress while minimizing lateral spring deflection; and at least one downwardly ext ending vertical bookend extending between said side walls and longitudinally movable in said hollow portion along said sidewalls by said spring members, said movable vertical bookend being capable of retaining at least one book between said bookend and a second vertical support.

2. The adjustable apparatus of claim 1, wherein said second vertical support is a vertical wall of a shelf unit.

3. The adjustable apparatus of claim 1, wherein said spring members are integral, forming one spring extending in a U shape along said side walls and an end wall extending between said side walls.

4. The adjustable apparatus of claim 1, wherein said second vertical support is a part of said apparatus.

5. The adjustable apparatus of claim 1, wherein said stationary base is integrally formed with a shelf.

6. The adjustable apparatus of claim 1, wherein said vertical bookend is guided for longitudinal movement in said hollow portion by said guide, said guide being located within said side walls.

7. The adjustable apparatus of claim 1, wherein said stationary base includes attachment means for affixing said base to said shelf.

8. The adjustable apparatus of claim 7, wherein said attachment means includes a plurality of holes located on said stationary base through which a plurality of attachment screws can be affixed to the shelf.

9. The adjustable apparatus of claim 7, wherein said attachment means includes an adhesive layer placed on an upper side of said stationary base.

10. Adjustable apparatus for retaining a variable number of books on a shelf unit having a horizontal shelf, the apparatus comprising:

a stationary base affixable to a lower side of the horizontal shelf, said base having two horizontally extending side wall members, said side wall members defining lengthwise edges of said base, said base further having a longitudinally extending central hollow portion between said side wall members;

two helical compressed spring members, one said spring member located substantially adjacent each said lengthwise edge in said side wall members;

at least one downwardly extending vertical bookend extending between said sidewalls and longitudinally movable in said hollow portion along said side wall members by said spring members, said movable vertical bookend being capable of retaining at least one book between said bookend and a second vertical support; and a guide within said side wall members for containing and guiding said spring members, allowing said spring members to longitudinally extend and compress while minimizing lateral spring deflection, said guide also guiding longitudinal movement of said vertical bookend.

11. The adjustable retaining apparatus of claim 10, wherein said spring members are integral, forming one spring extending in a U shape along said side wall members and an end wall extending between said side wall members.

12. The adjustable apparatus of claim 10, wherein said stationary base is integrally formed with a shelf.

13. The adjustable apparatus of claim 10, wherein said stationary base includes attachment means for affixing said base to said shelf.

14. The adjustable apparatus of claim 13, wherein said attachment means includes a plurality of holes located on said stationary base through which a plurality of attachment screws can be affixed to the shelf.

15. The adjustable apparatus of claim 10, wherein said attachment means includes an adhesive layer placed on an upper side of said stationary base.

16. Adjustable apparatus for retaining a variable number of books comprising:

a shelf unit having a horizontal member forming a base, said base having two horizontally extending side walls defining lengthwise edges of said base and a longitudinally extending central hollow portion between said side walls;

two helical spring members, one said spring member located substantially adjacent each said lengthwise edge;

a guide within said base for containing and guiding said spring members, allowing said spring members to longitudinally extend and compress while minimizing lateral spring deflection; and at least one downwardly extending vertical bookend extending between said side walls and longitudinally movable in said hollow portion along said sidewalls by said spring members, said movable vertical bookend being capable of retaining at least one book between said bookend and a second vertical support.

17. The apparatus of claim 16, wherein said shelf unit includes a shelf having a front face member located adjacent a front of said shelf and extending downward a distance below said shelf, said front face member and said shelf defining a recessed area under said shelf, said stationary base being affixed to said shelf within said recessed area.

18. The apparatus of claim 16, wherein said horizontal member is a shelf.

19. A method of retaining a variable number of books on a shelf unit having at least a horizontal shelf, the method comprising:

a) attaching a stationary base of an adjustable retaining apparatus on an underside of said horizontal shelf, said stationary base having two horizontally extending side walls defining lengthwise edges and a longitudinally extending central hollow portion between said side walls, said adjustable retaining apparatus further including two helical compressed spring members, one said spring member located substantially adjacent each said lengthwise edge, a guide within said base for containing and guiding said spring members, and at least one downwardly extending vertical bookend extending between said side walls.

20. The method of claim 19, wherein said stationary base includes a plurality of holes and said attaching step includes affixing an attachment screw through each of said holes and into said underside of said horizontal shelf.

21. The method of claim 19, wherein said attaching step includes affixing an adhesive layer between said stationary base and said horizontal shelf.

22. The method of claim 19, wherein said horizontal shelf includes a front face member extending downward from said shelf to define a recessed area behind said front face member and said attaching step attaches said stationary base to an underside of said shelf in said recessed area.

* * * * *